US005641247A

United States Patent [19]

Seligman

[11] Patent Number: 5,641,247

[45] Date of Patent: Jun. 24, 1997

[54] COMBINATION SPIDER AND BUOYANCY COMPENSATOR WITH INSERTABLE WEIGHTS

[75] Inventor: Scott Seligman, Carlsbad, Calif.

[73] Assignee: Sea Quest, Inc., Carlsbad, Calif.

[21] Appl. No.: 512,443

[22] Filed: Aug. 8, 1995

[51] Int. Cl.[6] ..... B63C 11/02

[52] U.S. Cl. ..... 405/186; 114/315; 224/191; 441/106

[58] Field of Search ..... 405/186; 441/88, 441/106; 224/191, 211; 114/315

[56] References Cited

U.S. PATENT DOCUMENTS

| | | | |
|---|---|---|---|
| 2,982,105 | 5/1961 | Akers | 405/186 |
| 3,135,098 | 6/1964 | Root | 405/186 |
| 3,263,432 | 8/1966 | Maskell . | |
| 3,670,509 | 6/1972 | Walters . | |
| 3,842,611 | 10/1974 | Anderson . | |
| 3,877,098 | 4/1975 | Braly | 405/186 |
| 4,016,616 | 4/1977 | Walters . | |
| 4,440,525 | 4/1984 | Perla . | |
| 4,608,940 | 9/1986 | Bulin . | |
| 4,778,307 | 10/1988 | Faulconer | 405/186 |
| 4,779,554 | 10/1988 | Courtney . | |
| 4,877,167 | 10/1989 | McNemar | 405/186 X |
| 4,887,932 | 12/1989 | Toth . | |
| 5,085,163 | 2/1992 | VanTassel . | |
| 5,205,672 | 4/1993 | Stinton . | |
| 5,311,833 | 5/1994 | VanTassel et al. . | |

FOREIGN PATENT DOCUMENTS

| | | |
|---|---|---|
| 2259010 | 2/1972 | France . |
| 2590540 | 5/1987 | France . |
| 964217 | 7/1962 | United Kingdom . |

*Primary Examiner*—Dennis L. Taylor

*Attorney, Agent, or Firm*—George F. Bethel; Patience K. Bethel

[57] ABSTRACT

A combination spider and buoyancy compensator having an insertable weight system. The spider includes an insertable weight system disposed preferably within at least one side opening pocket attached to a waistband portion. The side opening pocket can be formed of a piece of material attached to a waistband portion to define a channel in the space between the waistband portion and the piece of material. At least one weight disposed within an envelope, preferably having stiffening material, is removably inserted within the pocket. The envelope containing the weight includes means, preferably including areas of brushed material and hooks, and a handle for inserting, securing, and removably releasing the envelope containing the weight within the pocket. Stiffening within the spider provides an open, formed, shape retaining unit to distribute the weight of the tank and for convenience in putting the spider on.

20 Claims, 4 Drawing Sheets

COMBINATION SPIDER AND BUOYANCY COMPENSATOR WITH INSERTABLE WEIGHTS

FIELD OF THE INVENTION

This invention relates to the field of buoyancy compensators and particularly to a combination spider and buoyancy compensator having insertable weights and/or having stiffening material to provide body and prevent twisting.

DESCRIPTION OF THE PRIOR ART

Underwater diving preferentially requires the use of a buoyancy compensator having an inflatable bladder to provide for buoyancy trim or compensation to a diver.

Buoyancy compensators are inflated by oral power or compressed gas inflation means. During inflation, the diver is provided with increased buoyancy at greater depths to overcome the fact that a diver's buoyancy decreases as he dives deeper. This is because with greater pressure, a loss takes place regarding the lifting characteristics of the diver's buoyancy, primarily due to compression of his exposure suit and associated diving equipment.

Conversely, as the diver ascends or approaches the surface his buoyancy increases as the compression of his exposure suit and other equipment recovers. As inherent buoyancy is regained, air must be released from the buoyancy compensator to return the system to neutral buoyancy.

Thus, by increasing or decreasing the buoyancy provided by the buoyancy compensator, a diver can adjust his buoyancy to a neutral state. This is provided by either adding air to the buoyancy compensator or releasing it.

In recent years, buoyancy compensators have been combined with a vest configuration commonly called a spider with means to hold a diver's backpack that supports a container or tank of pressurized gas on a diver's back. The vest or spider configuration often includes a forward portion or chestbands attached to the shoulders of a back section and a front closing waist or belt fastener for ease in putting on and securing the buoyancy compensator. However, the flexible material causes the back and chestbands forming the shoulder or arm areas as well as the waistband to collapse and twist around themselves when not in use.

A weight belt is often used to assist in achieving neutral buoyancy. Commonly, this consists of a belt having weights attached to the belt. In an emergency, it is desirable to release the weights quickly.

A variation of the weight belt is in the form of a harness formed of a belt having attached shoulder straps which prevent the belt and weights from slipping off. The disadvantage of the harness is that, in an emergency, it is difficult to jettison the harness without becoming entangled with the straps.

Various quick release systems have been used such as a bottom opening pocket. Gravity is required for proper operation of these systems making the operation most effective with the diver's body in the vertical position.

The popular combination spider, backpack, and buoyancy compensator has made the use of a weight belt somewhat awkward and inconvenient to put on and to operate.

Also, the flexibility of the spider or vest causes the back, waistband, and arm or shoulder openings to collapse, twist and tangle so that the vest or spider is not easily accessible or removable.

As a consequence, it is an object of this invention to provide a combination spider and buoyancy compensator having a novel insertable weight system.

It is another object of the invention to provide a combination spider and buoyancy compensator with a backpack having a novel insertable weight system wherein the weights can be easily and quickly released from either a vertical or a horizontal orientation of a diver.

It is yet a further object of the invention to provide a combination spider and buoyancy compensator having stiffening material within the spider so that the combination can, at least in part, hold its shape when upright on a surface or remain in an extended, shaped position without twisting or folding over for ease in putting on and to better support, transfer and distribute the weight of a cylinder or tank of compressed breathing gas.

SUMMARY OF THE INVENTION

The novel combination spider and buoyancy compensator of the invention provides an insertable weight system disposed within at least one outer, side opening pocket located on the spider. The pocket is preferably located on the spider front.

The weights are enclosed within an envelope having a double flap. One flap is secured to the envelope to retain the weight within the envelope. The second flap is releasably secured to the exterior of the side opening pocket on the spider.

A tab with a knob at the end is attached to the second flap. Grasping of the knob with one hand allows for easy opening of the second flap. Pulling the knob and flap forwardly relative to the body of a diver enables the removal of the envelope containing the weights.

According to a preferred embodiment, at least a portion of the shoulder area, chest portions, back and waistband portions of the spider contain stiffening material sufficient so that the combination spider and buoyancy compensator is at least partially self-supporting, enabling it to stand upright at least in part or to remain extended or shaped. This provides convenience in attaching needed instruments and other diving accessories as well as convenience for a diver in putting on the combination unit.

A backpack can also be combined within the spider and buoyancy compensator unit.

BRIEF DESCRIPTION OF THE DRAWINGS

The invention will be more clearly understood by referring to the description below and the accompanying drawings in which.

DETAILED DESCRIPTION OF THE DRAWINGS

Figure 1:
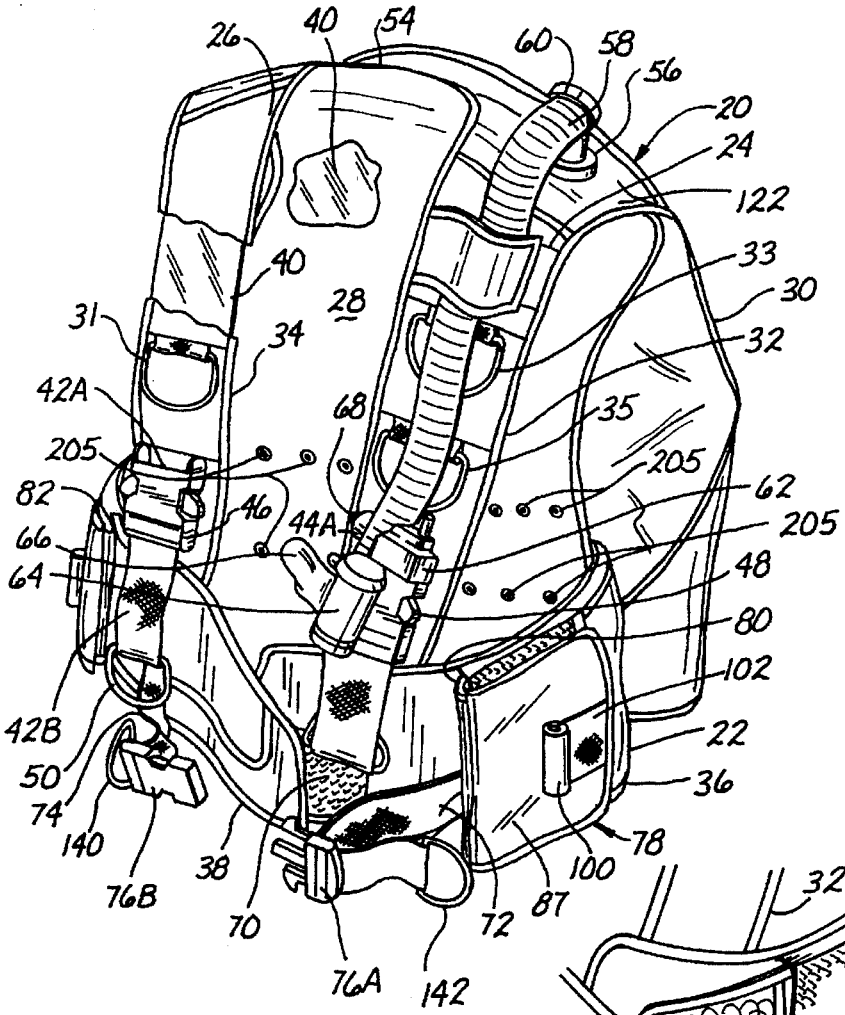
FIG. 1 shows a perspective view of the combination spider, buoyancy compensator, and backpack unit having an insertable weight system.
Figure 2:
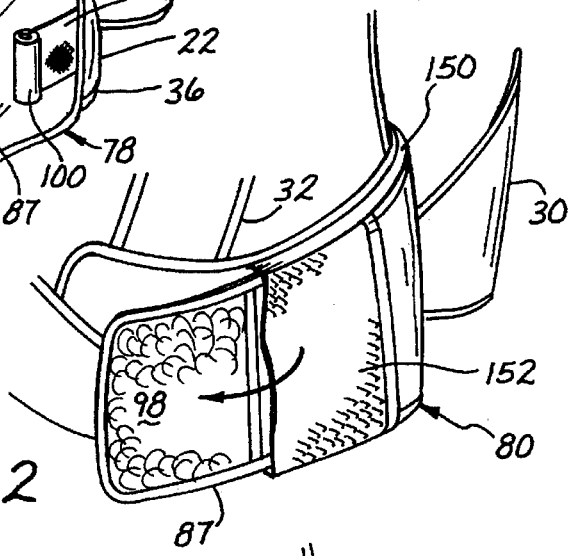
FIG. 2 shows a detail of the insertable weight system with a fastening flap of the envelope for containing the weights in the open position.
Figure 3:
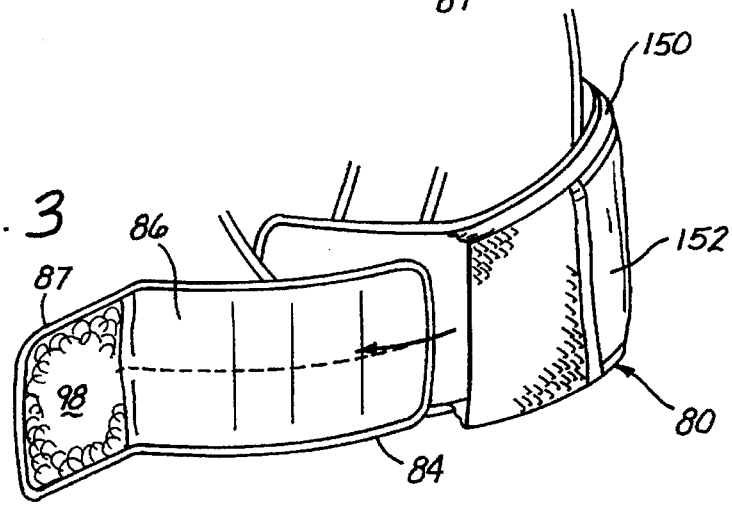
FIG. 3 shows a detail of the insertable weight system with the envelope for containing the weights removed from the spider.

Referring now to FIG. 1, there can be seen a perspective view of the combination spider and buoyancy compensator unit 20 of the invention.

The spider or vest 22 includes a back portion 28 having shoulder portions 24 and 26 which extend forwardly into chestbands or chest portions 32 and 34. The lower area of the back portion 28 extends forwardly into wide waist portions or waistbands 36 and 38.

The spider or vest 22 can be made of a double layer of material. The double layer preferably includes a stiffening material 40 in one or more of the shoulder areas 24 and 26, in the chestbands or chest portions 32 and 34, in the back portion 28 and in the waist portions or waistbands 36 and 38. The stiffening material 40 is shown in the partially broken away part of chestband 34.

The stiffening material 40 is particularly advantageous in providing a structural integrity or expanded support or shape to the vest or spider 22 so that the combination unit 20 can, at least in part, hold its shape.

The stiffening material 40 also allows an extended, unfolded, untwisted and unrestricted arm or shoulder opening. This is particularly desirable for attaching diving accessories to the unit 20 as well as for providing convenience to a diver when putting on the unit 20.

The stiffening material 40 can be in the form of a sheet of stiff plastic such as polyethylene, polypropylene or other strong, pliant material which is inserted within and preferably can be stitched or otherwise secured to or within the fabric layers of the vest or spider 22. In this manner, a sandwich construction can be achieved.

In place of the plastic, other materials can be substituted such as aluminum sheet, stainless steel sheet or other metal sheet. Metal reinforced plastics and various fiber reinforced plastics can also be used. These materials are less preferred than plastics primarily due to increased cost.

The thickness of the stiffening sheet of plastic or metal will depend upon the identity and strength characteristics of the particular plastic or metal used. Good results have been obtained using a plastic having a thickness in the range of about of 1/16 inch to about 3/8 inch.

Best results are obtained with stiffening material 40 disposed throughout the spider. This provides the desired resistance to twisting, bending, and folding. In addition, by including stiffening material 40 in the torso area, the weight or load of a tank or cylinder of compressed breathing gas can be better transferred to the spider.

This is especially true in the area of the back portion 28, the shoulder portions 24 and 26, the chestbands 32 and 34, and the waistbands 36 and 38. The back portion 28 meets the waistbands 36 and 38 at approximately a right angle. Preferably the back portion 28 is bolted or otherwise adjustably secured to the waistbands 36 and 38 as shown at 205 in FIGS. 1 and 10. This permits closer fitting around the waist of a diver.

Figure 10:
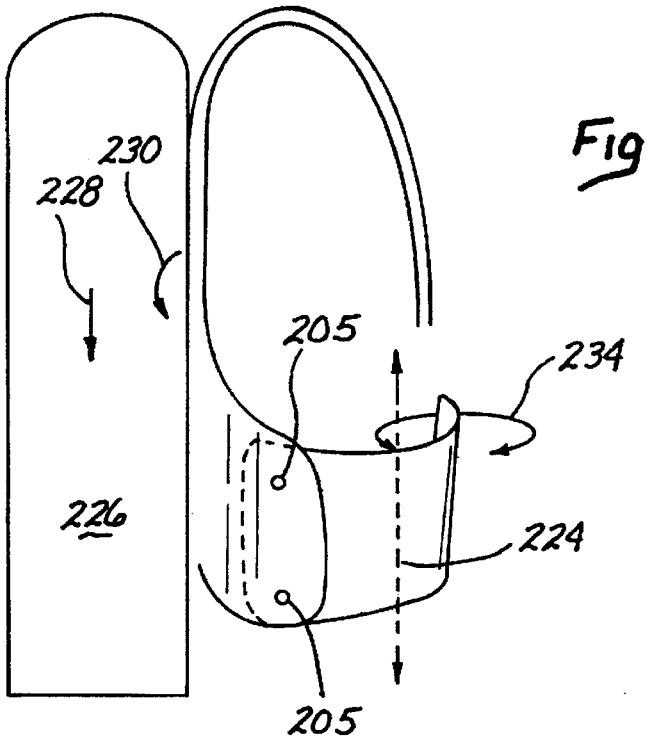
FIG. 10 shows a partially broken away side view of the stiffening material within the vest.

As particularly shown in FIG. 10, the weight of a cylinder or tank 226 causes the tank to lean back as indicated by arrow 230. The chestbands 32 and 34 are then tightened to try to pull the tank 226 up against the back of a diver. Normally, without the stiffening material 40, this action causes the waistbands 36 and 38 to move up.

Figure 11:
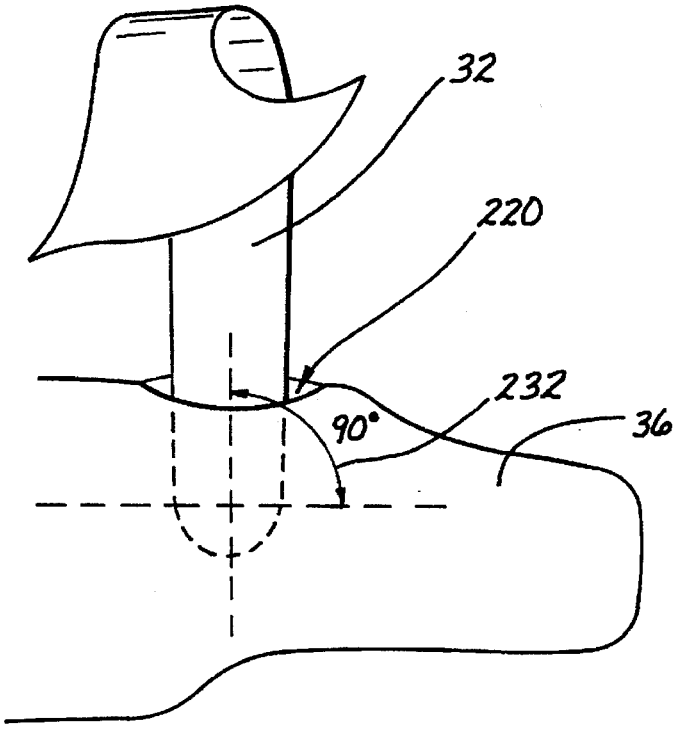
FIG. 11 shows a view of the stiffening material of the chestband and the waistband.

However, with the stiffening material 40 disposed within the waistbands 36 and 38, the back portion 28, the shoulder portions 24 and 26, and the chestbands 32 and 34, bending of the waistbands is resisted along the axis indicated by arrow 224. That is, the waistbands 36 and 38 are stiff in the vertical direction. This rigidity of the waistbands 36 and 38 is further increased by the approximate right angle formed between the waistbands 36 and 38 and the chestbands 32 and 34 as shown in FIG. 11 at 232.

A further advantage of having stiffening material 40 in the waistbands 36 and 38 is that it provides reinforcement for support of the insertable weight system to be described.

At the same time, the stiffening material 40 allows bending in the direction 234 of FIG. 10 for contouring around a diver's waist.

The waistbands 36 and 38 also form an approximate right angle with the back portion 28 forming a stiff framework for the vest or spider 22.

The stiffening material 40, then, permits the weight of a cylinder or tank of compressed breathing gas 226 to be distributed between the shoulders, back, and hips of a diver.

In the embodiment shown in FIG. 1, the chestbands or chest portions 32 and 34 preferably are received within waistbands 36 and 38 respectively. As detailed in FIG. 11, the chestbands 32 and 34 are received and held within a top opening pocket 220 disposed within waistbands 36 and 38.

Each pocket 220 has a lower strap 42B or 44B secured within it. An upper strap 42A or 44A is secured to chestband 34 and chestband 32 respectively. After insertion of the chestbands or chest portions 32 and 34 within the respective pockets 220, the length of the chest portions or chestbands 32 and 34 can be adjusted.

This is done by lengthening or shortening chest straps 44A and 44B, and 42A and 42B respectively. This causes the chestbands 34 and 32 to move upwardly or downwardly within each pocket 220. Each pair of chest straps 42A and 42B, and 44A and 44B are joined together by an interlocking buckle 46 and 48 respectively which also acts to secure the adjusted length of each pair of chest straps 42A and 42B, and 44A and 44B.

A ring 50 and a ring 52 attached to the end of chest straps 42B and 44B respectively provide a grasping means for pulling on each strap and adjusting it. In addition, the rings 50 and 52 can also be used to attach various diving accessories if desired.

Rings 31, 33, and 35 are attached to chestbands 32 and 34 for attachment of various diving accessories.

Figure 7:
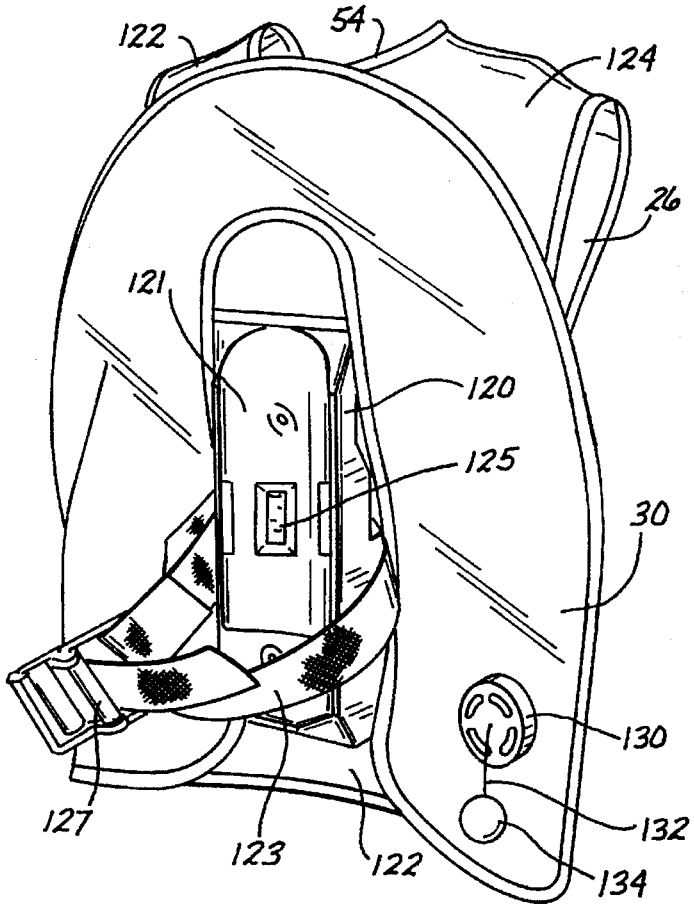
FIG. 7 shows a rear perspective view of the combination unit of the invention.

A backpack 120, shown in FIG. 7, is formed of a hard plastic into an inverted T-shape shown partially in outline. The backpack 120 is secured by stitching, riveting, and/or bolting to the back 28 of spider or vest 22.

In the embodiment shown in FIG. 1, the lower right and left portion of back 28 of spider or vest 22 are provided with spaced apart pairs of through openings 205 for bolting to waistbands 36 and 38. This provides a means of waistband size adjustment.

While the back portion 28 is bolted or otherwise adjustably secured to the waistbands 36 and 38, this is not required. The vest or spider 22 can be formed as a unitary structure. Also, the stiffening material 40 can also have a unitary, unbroken form or be provided in separate parts.

The stiffening material 40 can also be formed as an integral part of the vest or spider 22. In this case, the stiffening material 40 can be formed by laying the stiffening material out and die cutting it or stamping it out to the desired form. Webbing could then be fastened to it along with means to attach a tank to it.

The center area 121 of backpack 120 is contoured to conform to the curve of a pressurized breathing gas cylinder or tank. A strap 123 is threaded from the rear through opening 125 in the center area 121. The strap 123 can be tightened around a pressurized breathing gas cylinder and secured by a buckle 127.

A buoyancy compensator 30 includes an inflatable inverted U-shaped portion which overlies the back of the vest or spider 22 and surrounds the backpack 120. The buoyancy compensator 30 has shoulder portions 122 and 124 which are attached to the shoulder portions 24 and 26 and to the neckline 54 of the vest or spider 22. The bottom of the buoyancy compensator 30 is also secured to the bottom area of the back 28 of spider 22.

Referring now to FIG. 1, an opening 56 in the shoulder portion 122 of the buoyancy compensator 30 enables emplacement of an over pressure release valve 60 which is connected to an inflator tube 58. The end of the inflator tube 58 includes a high pressure inflation valve 62 and an oral inflator 64 having a mouthpiece 66. The high pressure inflation valve 62 is in fluid communication with a high pressure line from a tank or cylinder to be held in the backpack. The valve 62 operates by means of a valve button 68.

The release valve 60 can be released by means of pulling the inflator tube 58. The inflator tube includes a wire cable, not shown, which when pulled opens the release valve 60.

As shown in FIG. 7, a release valve 130 having a cord 132 attached to a ball handle 134 is disposed within the rear of the buoyancy compensator 30. Pulling on the ball handle 134 opens the release valve 130.

Such an air filling and release arrangement as described above is known to those skilled in the art. The invention is intended to include the combination of a spider with stiffening. The invention further includes the combination of a spider, and/or a buoyancy compensator, and/or a backpack with an insertable weight system disposed within the spider.

The waistbands 36 and 38 of spider 22 are provided with interlocking hooks and brushed areas 70 in the form of a Velcro™ like material for adjustable overlapping securement. The waistbands 36 and 38 have attached waist straps 72 and 74. The end of waist strap 72 is connected to a buckle part 76A and the end of waist strap 74 is attached to interlocking buckle part 76B.

Waist strap 74 has a ring 140 at the end for grasping to adjust the length of waist strap 74. Similarly, waist strap 72 has a ring 142 at the end to adjust the length of waist strap 72. The interlocking buckle parts 76A and 76B are joined together over the waistbands 36 and 38 to ensure against unwanted release of the waistbands 36 and 38. By pulling on the rings 140 and 142, the waist straps 74 and 72 can be shortened and tightened to secure the waistbands 36 and 38 from opening.

The insertable weight system indicated generally at 78 in FIG. 1 is detailed in FIGS. 2 through 6. As shown in FIGS. 1 through 6, outer, side opening pockets 80 and 82 are each formed by means of a strip of material 150 which is stitched along the parallel lengthwise edges to the exterior of waistbands 36 and 38. The pockets or channels 80 and 82 are formed within the space between the strip of material 150 and the waistbands 36 and 38.

At least a portion of the exterior of the strip of material 150 is provided with hooks or brushed material 152 in the form of a Velcro™ type attachment means.

An envelope or bag enclosure 84 for holding weights is inserted within the pockets 80 and 82. The envelope or bag enclosure 84 is formed of a first portion 86 having a flap 87. The first portion 86 is secured to a second portion 88 having at least one pouch, sack, or chamber 89 which is closed by a flap 92.

The first portion 86 and the second portion 88 are joined together at the edges. This can be done by any convenient means such as by stitching, adhesives, or heat sealing.

Figure 4:
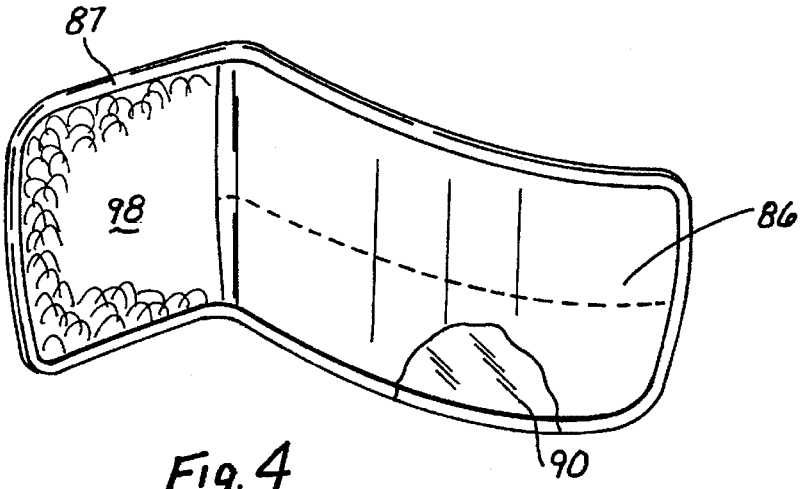
FIG. 4 shows a front perspective view of the envelope for containing the weights.
Figure 5:
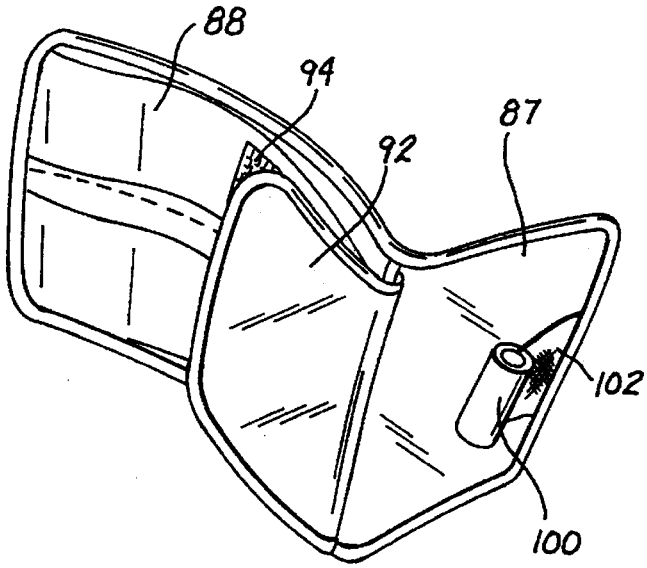
FIG. 5 shows a rear perspective view of the envelope for containing the weights with a weight closure flap in the closed position.
Figure 6:
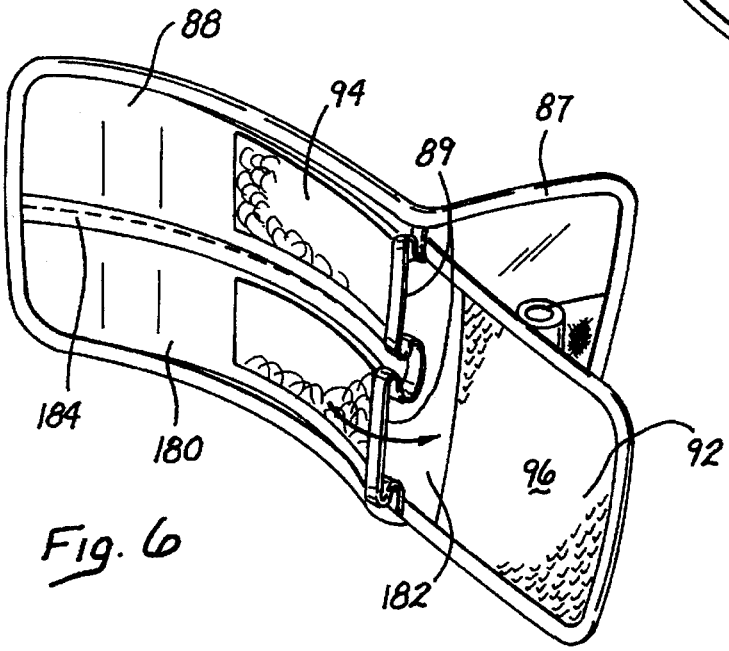
FIG. 6 shows a perspective view of the envelope shown in FIG. 5 with a weight closure flap in the open position to reveal the chambers which receive the weights.

Stiffening material 90 as shown in FIG. 4 is preferably disposed between the first portion 86 and the second portion 88 of envelope 84. The purpose of the stiffening material 90 is to provide some integrity or rigidity or shape to the envelope or bag enclosure 84 for ease of insertion within the pocket 80 or 82. The weights themselves can provide some rigidity if desired.

The drawings show two pouches or sacks 89 within the envelope 84 but more or less can be used. The pouches, chambers, or sacks 89 for the weights can be formed by means of an upper layer 180 and a lower layer 182 of material. A center lengthwise stitching 184 divides the envelope 84 into two pouches or chambers 89 and can extend through both the first portion 86 and the second portion 88 as well as through the stiffening material 90.

In addition, the upper layer 180 of material is wider than the lower layer 182 of material. The extra material is formed into pleats or gathers which increase the thickness of the pouches or chambers 89 for ease in inserting weights.

The interior of the flap 92 and the exterior of the pouches or chambers 89 are provided with at least one area of Velcro™ type brushed material 94 and interlocking hooks 96. Weights are inserted within the pouches or chambers 89 and retained by the flap 92.

The inner surface of the flap 87 is provided with areas of brushed material or hooks 98 for interlocking with areas of brushed material or hooks 79 on material 77.

The outer surface of the flap 87 is provided with a spool, handle, or knob 100 attached to a tab 102. The tab 102 is stitched or otherwise secured at least in part to flap 87.

The envelope or bag 84 containing the weights is inserted within the outer side opening pocket 80 or 82. The hooked or brushed area 98 of flap 87 is secured by interlocking with the hooked or brushed area 79 of material 77 of pocket 80 or 82. The inserted and closed flap position can be seen in FIG. 1.

In order to release the envelope 84, the knob, handle, or spool 100 is grasped with one hand and pulled. This releases the interlocking areas of brushed material and hooks 98 on the flap 87 and areas of brushed material and hooks 79 on the material 77 respectively. This first release step can be seen in FIG. 2. By continuing to pull, the envelope 84 containing the weights slides out from the pocket 80 or 82 and can be allowed to drop away from the diver.

Figure 8:
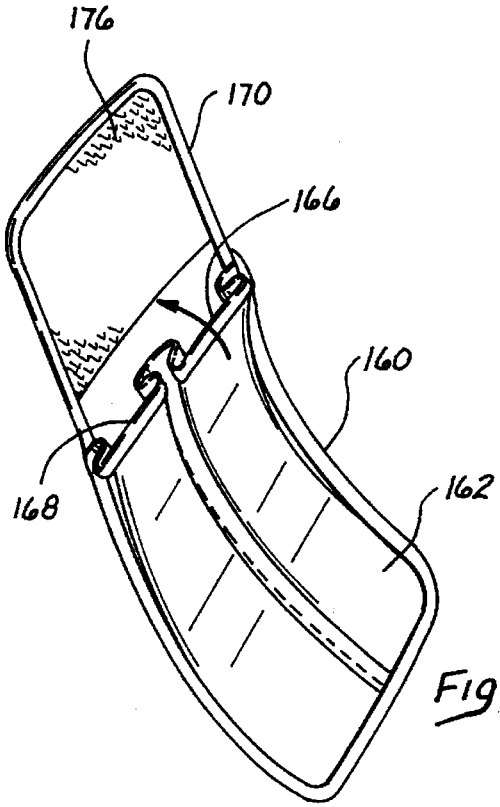
FIG. 8 shows another embodiment of an envelope for containing the weights having a single, combined weight closure and release and securement flap.
Figure 9:
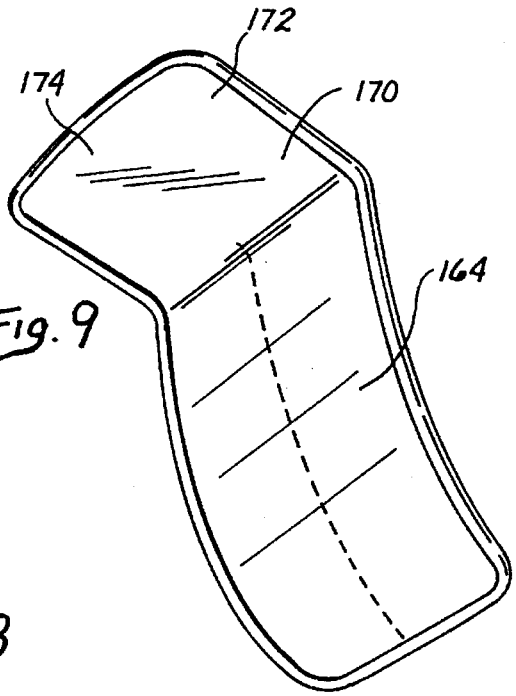
FIG. 9 shows the reverse perspective view of the envelope of FIG. 8.

Another embodiment of the envelope for holding the weights is shown in FIGS. 8 and 9. As shown, the envelope 160 has a first portion 162 and a second portion 164. The first portion 162 is wider than the second portion 164 and is formed into two chambers 166 and 168. The second portion 164 is longer than the first portion 162. The excess length of the second portion 164 is formed into a flap 170.

The flap 170 has a knob, ball, or handle 172 attached to a short strap 174 secured to the exterior side of the flap 170. The inner side of the flap 170 is provided with areas of hooks or brushed material 176. The flap 170 acts as a combined weight closure and envelope securement and release means.

When inserted into pocket 80 or 82, the flap 170 is folded over the material 77 so that the areas of hooks or brushed material 176 of flap 170 interlock with the areas of hooks or brushed material 79 of the material 77.

In order to release the envelope 160, the knob or spool 172 is grasped with one hand and pulled. This releases the interlocking areas of brushed material and hooks 176 on the flap 170 and areas of brushed material and hooks 79 on the material 77 respectively. This first release step is similar to that shown in FIG. 2. By continuing to pull, the envelope 160 containing the weights slides out from the pocket 80 or 82 and can be allowed to drop away from the diver.

The envelope 84 or 160 can be made of any convenient material. For example, the envelope can be made of rip stop nylon, or of a mesh material as desired. The weights can be sewn or otherwise secured within the envelope 84 or 160 or the flap 170 or 92 can secure the weights within the envelope.

Preferably, the envelopes 84 or 160 contain stiffening material 90 to shape the envelopes and to aid in insertion of the envelopes into the pockets 80 or 82. However, stiffening material 90 is not required.

Preferably, the pockets 80 and 82 have an opening which is generally perpendicular to the long axis of a diver and opens in front of a diver so that when a diver is in a horizontal, face down, swimming position, the weights can be released downwardly. However, although less preferred, the pocket can be oriented upwardly or downwardly relative to the long axis of a diver.

Various modifications of the invention are contemplated and can be resorted to without departing from the spirit and scope of the invention as defined by the following claims.

I claim:

1. A combination spider and buoyancy compensator having an insertable weight system wherein:

said spider comprises two shoulder portions, two chest portions and a back portion extending from the two shoulder portions, and two waistband portions which extend from the back portion for fastening around a diver's waist;

said insertable weight system comprises:

at least one pocket attached to said waistband portion for receiving and removing at least one weight;

at least one envelope for said at least one weight removably insertable within said pocket; and, means for securing and removably releasing said envelope containing said at least one weight within said pocket.

2. A combination spider and buoyancy compensator according to claim 1 wherein said pocket comprises:

a piece of material attached to said waistband portion to define a channel in the space between said waistband portion and said piece of material and has a side opening.

3. A combination spider and buoyancy compensator according to claim 1 wherein:

said means for securing and releasing said envelope containing said at least one weight within said pocket comprises:

at least one first fastener attached to said pocket and at least one second fastener attached to said envelope for interlocking with said first fastener.

4. A combination spider and buoyancy compensator according to claim 1 further comprising:

means attached to said envelope for grasping.

5. A combination spider and buoyancy compensator according to claim 4 wherein:

said grasping means comprises at least in part, a tab.

6. A combination spider and buoyancy compensator according to claim 4 wherein:

said envelope comprises at least one first portion and at least one second portion defining at least one chamber for receiving at least one weight.

7. A combination spider and buoyancy compensator as claimed in claim 6 wherein:

said at least one first portion and said at least one second portion further define at least one flap.

8. A combination spider and buoyancy compensator as claimed in claim 7 wherein:

at least a portion of said at least one first portion or of said at least one second portion of said envelope further contains stiffening material.

9. A combination spider and buoyancy compensator according to claim 7 wherein:

said buoyancy compensator comprises a back portion having two shoulder portions and two downwardly extending lobe portions, each lobe portion having a bottom and side portions;

securement means for securing at least a portion of said buoyancy compensator to said spider;

said back portion of said spider further includes a backpack for holding a cylinder of pressurized breathing gas; and, securement means associated with said at least one flap and at least one of said at least one first portion and said at least one second portion of said envelope for closure to secure said weight within said chamber.

10. A removable weight system for a combination spider and buoyancy compensator having a waistband portion comprising:

at least one outer pocket attached to said waistband portion for receiving and removing at least one weight;

at least one envelope for said at least one weight removably insertable within said outer pocket; and, means for securing and releasing said envelope containing said at least one weight within said pocket.

11. A removable weight system according to claim 10 wherein:

said pocket has a side opening and is formed from a piece of material attached to said waistband portion to define a channel in the space between said waistband portion and said piece of material and, wherein said means for securing and releasing said at least one weight within said pocket comprises:

at least one first fastener attached to said pocket and at least one second fastener attached to said envelope for interlocking with said first fastener.

12. A removable weight system for a combination spider and buoyancy compensator according to claim 10 further comprising:

means attached to said envelope for grasping;

said envelope for said at least one weight comprises at least one first portion and at least one second portion defining at least one chamber for receiving at least one weight; and, said at least one first portion and said at least one second portion define at least one flap.

13. A removable weight system according to claim 12 wherein:

at least a portion of at least one of said at least one first portion and said at least one second portion of said envelope further contains stiffening material; and, securement means associated with said at least one flap and at least one of said at least one first portion and said at least one second portion of said envelope for closure to secure said weight within said chamber.

14. A removable weight system according to claim 13 wherein:

at least a portion of said grasping means comprises a tab;

said securement means comprises interlocking hooks and brushed material disposed on said at least one flap and on at least one of said first portion and on at least one of said second portion of said envelope; and, said at least one first fastener attached to said pocket and said at least one second fastener attached to said envelope comprise interlocking hooks and brushed material.

15. A removable weight system for a combination spider and buoyancy compensator according to claim 12 wherein:

said grasping means comprises a tab having one end secured to said at least one flap, and an opposite end attached to a handle for opening said flap.

16. A combination spider and buoyancy compensator wherein:

said spider comprises two shoulder portions, two chest portions and a back portion extending from the two shoulder portions, and two waistband portions which extend from the back portion for fastening around a diver's waist;

stiffening material disposed within at least a portion of said spider which is sufficient to permit that portion of said spider to substantially retain its shape; wherein:

said buoyancy compensator comprises a back portion having two shoulder portions and two downwardly extending lobe portions, each lobe portion having a bottom and side portions, securement means for securing at least a portion of said buoyancy compensator to said spider; and, said stiffening material is disposed within said back portion and said waistband portions of said spider.

17. A combination spider and buoyancy compensator according to claim 16 wherein:

said stiffening material is disposed substantially throughout said spider.

18. A combination spider and buoyancy compensator according to claim 17 wherein:

said back portion of said spider further includes a backpack for holding a pressurized breathing gas tank.

19. A combination spider and buoyancy compensator having stiffening material disposed therein, said stiffening material characterized by resistance to bending along one axis;

wherein:

said spider comprises two shoulder portions, two chest portions and a back portion extending from the two shoulder portions, and two waistband portions which extend from the back portion for fastening around a diver's waist;

said buoyancy compensator comprises a back portion having two shoulder portions and two downwardly extending lobe portions, each lobe portion having a bottom and side portions;

securement means for securing at least a portion of said buoyancy compensator to said spider;

said back portion of said spider further includes a backpack for holding a cylinder of pressurized breathing gas; and, said stiffening material comprises metal or plastic sheeting and is disposed at least within said waistbands of said spider.

20. A combination spider and buoyancy compensator according to claim 19 wherein said stiffening material comprises plastic sheeting having a thickness in the range of 1/16 inch to about 3/8 inch; and, said stiffening material being disposed substantially throughout said spider.

* * * * *